US005483722A

United States Patent [19]

Scheier et al.

[11] Patent Number: 5,483,722

[45] **Date of Patent: * Jan. 16, 1996**

[54] TOOTHBRUSH WITH RESILIENT FLEXIBLE BRISTLE SUPPORT

[76] Inventors: Paul A. Scheier; Louise E. Scheier, both of 220 Central Park South, New York, N.Y. 10019

[ * ] Notice: The portion of the term of this patent subsequent to Oct. 18, 2011, has been disclaimed.

[21] Appl. No.: 277,532

[22] Filed: Jul. 19, 1994

Related U.S. Application Data

[63] Continuation of Ser. No. 989,163, Dec. 11, 1992, Pat. No. 5,355,546.

[51] Int. Cl.[6] ..... A46B 9/04

[52] U.S. Cl. ..... 15/167.2; 15/167.1; 15/201; 15/DIG. 5

[58] Field of Search ..... 15/167.1, 167.2, 15/186, 187, 201, 202

[56] References Cited

U.S. PATENT DOCUMENTS 2,706,825 4/1955 Blakeman ..... 15/167.1

4,633,542 1/1987 Taravel ..... 15/167.1

FOREIGN PATENT DOCUMENTS 0640683 12/1963 Belgium ..... 15/167.2

0023407 2/1981 European Pat. Off. ..... 15/167.1

0000745 of 1886 United Kingdom ..... 15/167.2

*Primary Examiner*—David Scherbel

*Assistant Examiner*—Randall E. Chin

*Attorney, Agent, or Firm*—Dann, Dorfman, Herrell and Skillman

[57] ABSTRACT

A toothbrush is set forth in which the bristles are mounted on a readily flexed resilient member supported from a handle by means of one or more handle extensions. The bristles are arranged in arrays with a center array for engaging the biting surface of a tooth and outer arrays for simultaneously engaging the sides of the tooth and adjacent gums when the resilient member is flexed by the engagement of the center array bristles with the tooth. The resilient member can be flat or arcuate and bristles can project from either side of the resilient member. A double headed toothbrush is also described.

11 Claims, 2 Drawing Sheets

FIG. 3
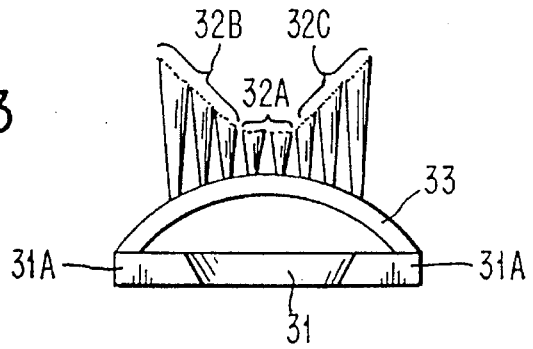
FIG. 4
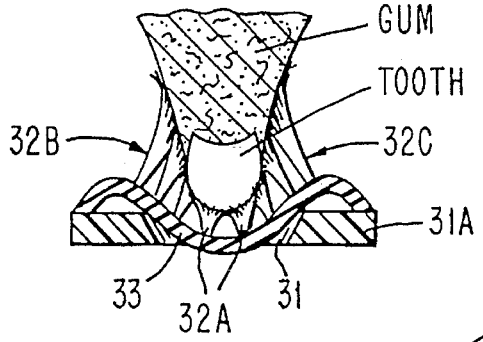
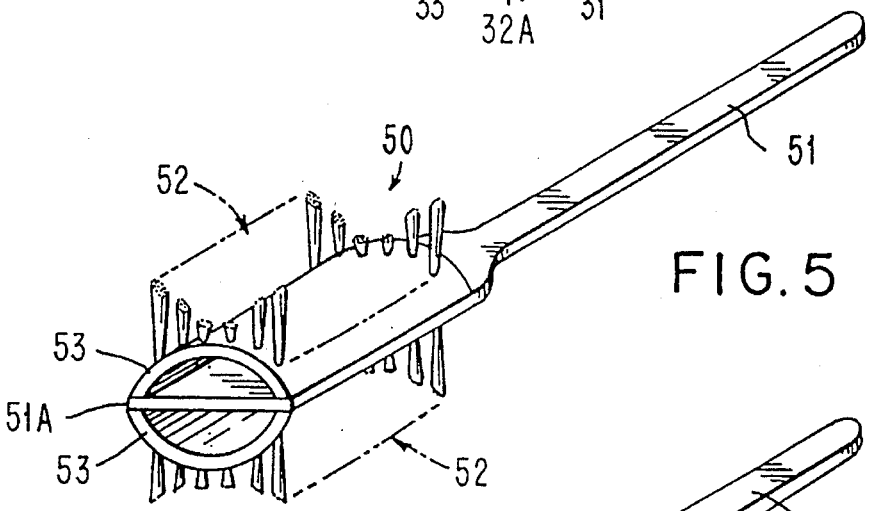
FIG. 5
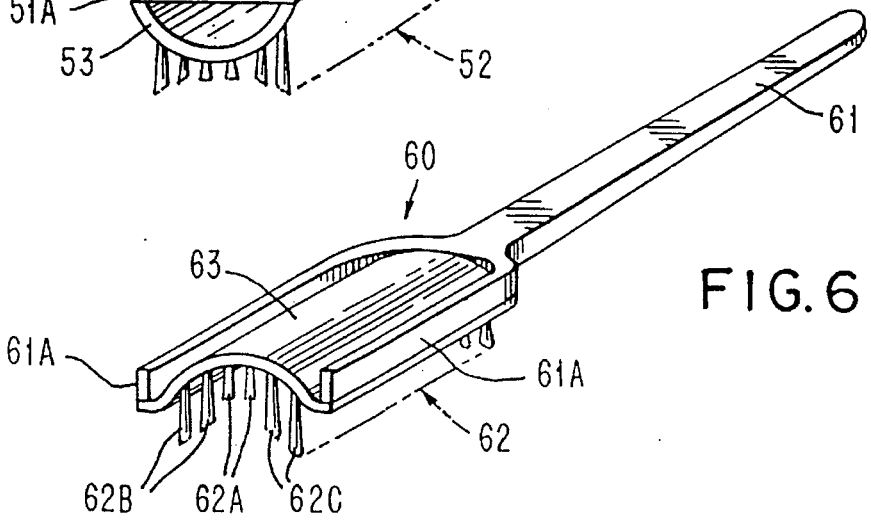
FIG. 6

TOOTHBRUSH WITH RESILIENT FLEXIBLE BRISTLE SUPPORT

This is a continuation of application Ser. No. 07/989,163, filed Dec. 11, 1992, now U.S. Pat. No. 5,355,546.

BACKGROUND OF THE INVENTION

This invention relates to toothbrushes for use in cleaning teeth and gums, and more particularly to a toothbrush in which the bristles are carried by a resilient, readily flexed matrix or bristle holder.

U.S. Pat. No. 229,823 granted to Holz et al. Jul. 13, 1880 and U.S. Pat. No. 864,054 to Abrams Aug. 20, 1907 each relate to toothbrushes having bristles fixed to the interior of a generally U-shaped base connected to the toothbrush handle.

U.S. Pat. No. 569,870 granted to Hamilton Oct. 20, 1896 relates to a toothbrush having two brush-backs connected together in inclined relation and to a handle, the member connecting the brush-backs being described as being made of any suitable material "such as spring metal or . . . the same material as the brush-backs . . . "

U.S. Pat. No. 2,214,407, granted to A. A. Deutsch Sep. 10, 1940 relates to a toothbrush having a three part brush head made up of a base plate joining two opposed arms forming a rigid array of brushes which is U-shaped in transverse cross section. In one arrangement, a resilient material is used to connect each of the arms to the bottom plate so that the bristles of the arms can engage the teeth of the user even though they vary in seize.

U.S. Pat. No. 3,853,412, granted to G. D. Griffin Dec. 10, 1974, relates to a tooth cleaning ball which is intended to effect the cleaning of the teeth while it is being chewed upon. Groups of bristles are mounted about a resilient body disclosed as a hollow ball, a cylinder or a combination thereof. A dentifrice is provided in the hollow device which is intended to be forced out through openings in the wall of the device when it is chewed.

U.S. Pat. No. 4,131,967, granted to Nörtthemann et al. Jan. 2, 1979, relates to a toothbrush having a bifurcated bristle-carrying head carrying two sets of bristles fixed in side-by-side spaced relation, with the bristle sets each being inclined toward the other. The head is connected to the front end of a handle by which the head is manipulated. Both the bristle-carrying head and the handle are formed of relatively rigid material and, as is conventional, to maintain the required mutual alignment of the opposed sets of bristles for engaging the opposite surfaces of teeth as intended.

U.S. Pat. No. 4,409,701, granted to Perches Oct. 18, 1983, relates to a toothbrush having exterior bristles fixed to the head and interior bristles fixed to a movable member [20]. Unless a pusher [26] is interposed between the head and the movable member 20, the free ends of the interior and exterior bristles extend in the same plane. When the pusher [26] is moved into position between the head and the movable member, the interior bristles are shifted distally a distance corresponding to the thickness of the pusher [26] above the plane of the exterior bristles.

U.S. Pat. No. 5,054,154 granted to Schiffler et al. Oct. 8, 1991 relates to a toothbrush in which the portion of the toothbrush handle that supports the bristle head is joined to the rest of the handle by means of a resilient hinge-like segment to permit flexing when excessive force is applied during use.

The foregoing illustrates many forms of toothbrushes hitherto proposed as well as some arrangements of single and multiple brush-heads which provide for relative movement but none discloses or suggests the toothbrush head of the present invention.

SUMMARY OF THE INVENTION

It is therefore, a principal object of this invention to provide a toothbrush which is uniquely suited for simultaneously cleaning the opposite surfaces of teeth, including areas below the gum line, An other object is to provide such a toothbrush which facilitates the removal of tartar, plaque and other matter from all surfaces of teeth and the bristles of which are supported so that at least the bristles intended to engage the sides of the teeth become more-or-less inclined toward the teeth and gum line as the toothbrush more-or-less closely engages the teeth.

A unique feature of the present invention resides in the provision of a toothbrush having its bristle tufts mounted on a readily flexed resilient member, preferably in the form of an elongated sheet. When the central portion of the brush is pressed against the teeth, the resilient member is readily displaced from its normal rest or starting position so as to change in shape and size thereby bringing the outer bristles into engagement with the teeth and adjacent gums with at least some of the bristles on each side of an engaged tooth being optimally directed into engagement with the gingival sulcus area under the gum at the base of the tooth as will be more fully described hereinafter.

Further objects and advantages of the present invention will be apparent from the following detailed description and the accompanying drawing in which:

FIG. 3 is an end elevational view of another embodiment of a toothbrush constructed in accordance with the present invention showing the bristle end when not in use and drawn to an exaggerated scale;

FIG. 4 is a cross sectional view showing the toothbrush of FIG. 3 in use;

FIG. 5 is a perspective view of a double headed toothbrush in accordance with the present invention suitable for simultaneously brushing the lower and upper teeth; and FIG. 6 is a perspective view of yet another embodiment of the present invention showing the brush bristles extending inwardly from the concave inner surface of a resilient member.

DETAILED DESCRIPTION

The embodiments of this invention, each comprises a readily flexed resilient member which carry the bristles for cleaning the teeth and gums. The resilient member can be planar or arcuate in shape and is formed of any natural or synthetic elastomeric material that can temporarily change in shape and size, and has other properties suitable for the intended use. Such elastomers include low or high density polyethylene, tetrafluoroethylene (Teflon), polyurethane and polypropylene. The bristle tufts can be secured to the resilient member in any suitable manner, including mechanical, adhesive or fusion means, as well as combinations thereof and injection molding techniques. Thus, while one such arrangement will be shown and described hereinbelow, those skilled in the art will be aware of other ways of affixing the bristles to the resilient member. It is also contemplated that the resilient member be made up of a plurality of laminae bonded together so as to encapsulate wire staples which serve to anchor the bristle tufts to the resilient member.

Figure 1:
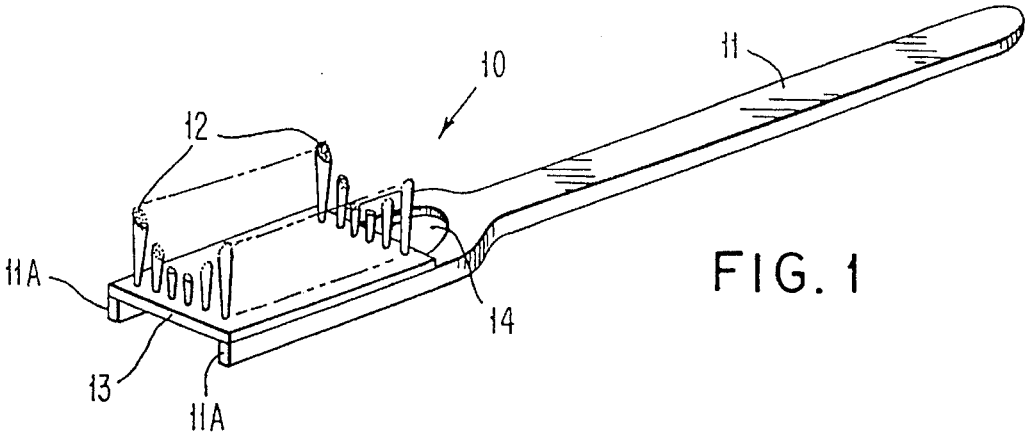
FIG. 1 is a perspective view, on an exaggerated scale for clarity, of a toothbrush constructed in accordance with the present invention showing the bristle end when not in use, and partially cut away for convenience.
Figure 1A:
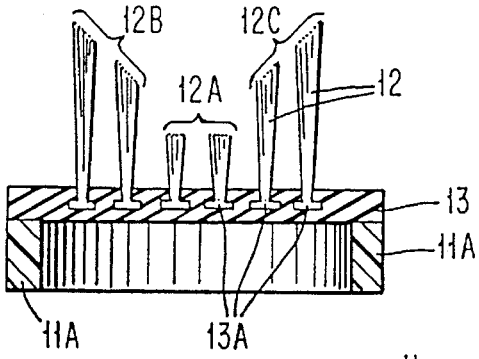
FIG. 1A is a transverse sectional view through a row of bristle tufts.
Figure 2:
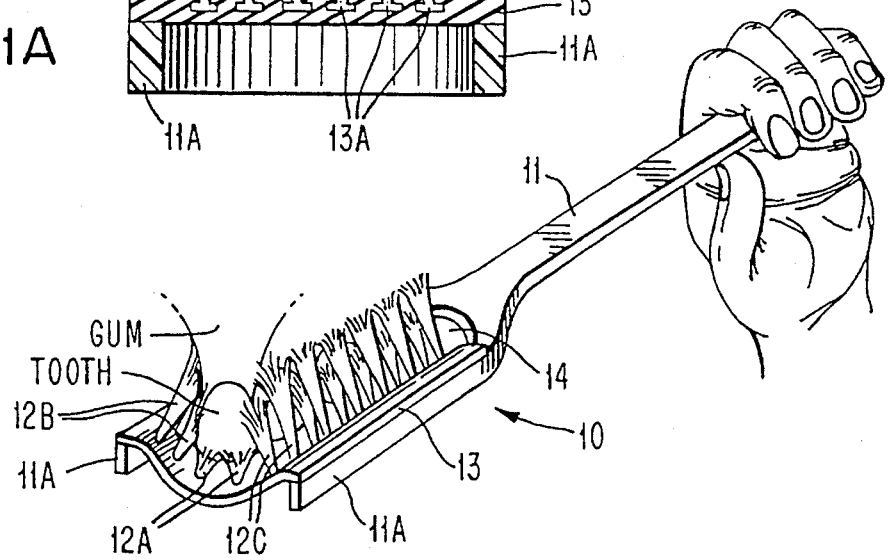
FIG. 2 is a view showing that toothbrush in use.
Figure 2A:
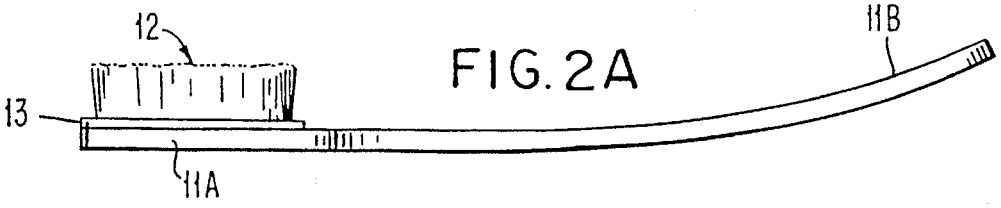
FIGS. 2A and 2B are views showing modifications of the handle of the toothbrush.
Figure 2B:
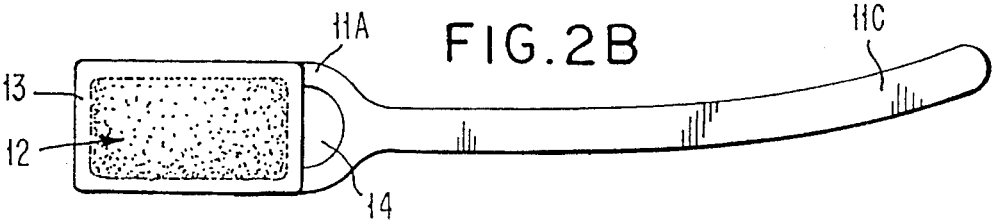

Turning now to FIGS. 1 through 2B, as an exemplary embodiment of the present invention, toothbrush 10 comprises a handle 11 and bristles 12, the latter being carried by resilient sheet-like member or diaphragm 13 which, as shown, is supported along its longitudinally extending edge portions by handle extensions 11A. Handle 11 and bristles 12 are made of nylon or any other material suitable for use in the manufacture of toothbrushes. Resilient member 13 is in the form of a sheet made of any suitable elastomeric material, as noted hereinabove. The bristles 12 of each tuft are fixed together at their proximal ends and to the resilient member 13. As shown, the tufts are each formed with a flattened base that is sealed as indicated at 13A in resilient member 13. The tufts of bristles 12 are arranged in columns extending longitudinally with respect to the handle 11 and in rows extending transversely thereto, but as is well known, the tufts can be arranged in any desired pattern. The bristle tufts fixed to unanchored and free to flex parts of the resilient member 13 extend in parallel relation to one another so long as the resilient member is not displaced from its normal, rest position. When peripheral tufts are set in the peripheral parts of resilient member 13 which are fixed to the handle extensions 11A, they also extend in parallel relation but are not free to incline in use with flexing of the resilient member 13. If desired, the portions of the resilient member fixed to the extensions 11A can be left free of bristle tufts or such peripheral tufts can be set so as to be substantially parallel to an adjacent tuft when the latter becomes inclined because of the flexing of member 13.

Depending upon the brush-head width desired, more or less bristle tufts are included in the innermost and/or outer of the bristle arrays of each row of bristles. For example, as shown in FIG. 1, each row has three arrays with two tufts of bristles in each array. Axial or central bristle array 12A is made up of relatively short bristles as compared to the remaining arrays and are intended primarily for cleaning and polishing the biting surfaces of the teeth. The outer arrays 12B and 12C are made up of longer bristles. As shown, bristle arrays 12B and 12C are tapered so that the bristles of tufts 12B and 12C are shortest adjacent bristle array 12A. The distal ends of the bristle tufts 12B and 12C form an angle of about 45° with the axis of the tufts so that when the tufts incline in response to flexing of the resilient member 13, their end faces will more closely parallel the surfaces of the engaged teeth and gums.

To facilitate depressing the distal ends of the extensions 11A so as to properly engage the bristles with the teeth and gums, the extensions 11A, as most clearly shown in FIG. 1, are somewhat longer than the resilient member 13 to leave an opening 14 so that when the distal end of the handle 11 is urged toward the gum line, the teeth positioned just forward of the tooth or teeth engaged by resilient member 13 can pass through opening 14 and do not block the desired stretching of resilient member 13.

As shown in FIG. 2, the toothbrush 10 when used is applied to the teeth by bringing the center bristles 12A against the biting surface of the teeth and then by pressing handle extensions 11A in a direction to carry them with the attached resilient member 13 to below the gum line far enough for the left and right arrays 12B and 12C to engage the inner and outer surfaces of the teeth and gums, the biting surfaces of which are engaged by the center bristle array. Essentially the same manipulation as for a single head toothbrush is used to clean the teeth as well as massage and clean the gums except that the center array 12A is maintained in contact with the biting surfaces of the teeth and the angle at which the left and right bristles are presented is adjusted as desired by reducing or increasing the pressure on handle 11 and thereby accordingly displace the proximal ends of center bristles 12A away from or toward the biting surfaces of the engaged teeth.

Instead of or in addition to opening 14, all or part of the extensions **11*a* and/or an adjacent portion of the handle 11 are mutually inclined so as to form an obtuse angle. Referring to FIG. 2A, handle 11 and extensions 11A are shown forming an obtuse angle between them. As shown in FIG. 2B cleaning of the rearmost teeth and gums is also facilitated by horizontally (as viewed in the drawing) offsetting the handle 11 with respect to the extensions 11A. When desired, this feature can be combined with the vertical inclination of the handle 11 with respect to the extensions 11A**.

Referring to FIGS. 3 and 4, toothbrush 30 is another example of the present invention and comprises handle 31, handle extension 31A and shaped, readily flexed, resilient member 33 to the convex surface of which bristles 32 are attached in arrays 32A, 32B and 32C. Here and in connection with further embodiments hereinafter to be described, the reference characters applied to the various parts serve to identify the figure in which the embodiment is first shown and to identify similar parts in other embodiments but with the noted differences. Thus, in the case of reference character "32A", the tens digit "3" refers to FIG. 3 and the units digit plus suffix, "2A" serves to identify the bristle array. In this embodiment, resilient member 33, like member 13, is also formed of elastomeric material and is readily flexed but is shaped so as normally to be arcuate in transverse cross section as shown in FIG. 3. The axially extending edges of the resilient member 33 are preferably attached to spaced apart extensions 31A of the handle 31 and at rest forms a C-shaped body, which as viewed in FIG. 3, has been rotated 90° clockwise. It will be noted that center array 32A has two columns of bristles and each of the arrays 32B & 32C contains three columns of bristles. In use, toothbrush 30 is applied to the teeth and gums as was described in connection with toothbrush 10. However, the brush bristles being attached to a convex rather than a planar surface results in the resilient member 33 taking on a bow shape in transverse cross section (FIG. 4) when the central bristles 32A are urged against the teeth so that the portions of member 33 which carry bristles 32B and 32C deflect the same inward into engagement with the sides of the teeth and the adjacent gums. While handle extensions 31A are shown as a bifurcation of the handle 31, the handle, if desired, is readily provided with a unitary extension in place of the extensions 31A.

A further embodiment of the present invention is exemplified by toothbrush 50, FIG. 5, which is similar to toothbrush 30 but has two bristle heads. Thus, toothbrush 50 comprises handle 51, extensions 51A, and two oppositely presented, readily flexed resilient members 53, carrying bristles 52, connected in opposed relation to the opposite sides of handle extensions 51A and with their concave surfaces inwardly presented toward each other. The axially extending edge portions of the resilient members 53 are connected to the corresponding portions of handle extensions 51A thereby forming a two headed toothbrush uniquely suited to engage the upper or lower teeth and gums individually, depending upon which direction the assembly is urged by the user, or by engaging the toothbrush 50 between opposed upper and lower teeth, the upper and lower teeth and gums are cleaned and polished at the same time.

Referring to FIG. 6, toothbrush 60 comprises handle 61 having a pair of elongated, parallel extensions 61A supporting a shaped, readily flexed, resilient member 63 bridging and attached along its longitudinal edge portions to handle extensions 61A. Like resilient member 33, resilient member 63 is arcuate in cross section but bristles 62 are attached thereto so as to project from the inner, concave side thereof. As before, while any desired arrangement of the bristles 62 can be used in carrying out the present invention, the bristles are arranged in a center array 62A, a left array 62B and a right array 62C. In use, the center array of bristles 62A is brought against the biting surfaces of the teeth to be cleaned by manipulating the handle 61 as was described in connection with toothbrush 10. Increasing force applied through handle 61 with center bristle array 62A in engagement with the biting surface of one or more teeth serves to bring bristle arrays 62B and 62C into engagement with the inner and outer surfaces of the engaged teeth and gums.

The terms and expressions which have been employed are used as terms of description and not of limitation. There is no intention in the use of such terms and expressions of excluding any equivalents of the features shown and/or described, or portions thereof. It is to be recognized, however, that various modifications are possible within the scope of the invention claimed.

What is claimed is:

1. A toothbrush comprising:

a resilient member formed for resilient flexure between a first shape and a second shape, said resilient member having a front end, a back end, and first and second sides;

means for supporting said resilient member at the first and second sides thereof such that said resilient member is free to flex between said first and second sides when stressed;

an array of first bristle tufts positioned centrally relative to the first and second sides of said resilient member, each of said first bristle tufts having a free end and a fixed end that is affixed to said resilient member;

a first array of second bristle tufts aligned in parallel relation to said first bristle tufts and positioned between said array of first bristle tufts and the first side of said resilient member, each of said second bristle tufts in said first array having a free end and a fixed end that is affixed to said resilient member, said second bristle tufts in said first array being longer than said first bristle tufts and being unconstrained from inclining relative to said array of first bristle tufts; and a second array of second bristle tufts aligned in parallel relation to said first bristle tufts and positioned between said array of first bristle tufts and the second side of said resilient member, each of said second bristle tufts in said second array having a free end and a fixed end that is affixed to said resilient member, said second bristle tufts in said second array being longer than said first bristle tufts and being unconstrained from inclining relative to said array of first bristle tufts;

wherein said first and second arrays of second bristle tufts are dimensioned and positioned relative to said array of first bristle tufts such that when the free ends of said first bristle tufts are pressed against the biting surface of a tooth, said resilient member is caused to stretch so as to change its size and shape whereby said first and second arrays of second bristle tufts are caused to incline toward the array of first bristle tufts such that, simultaneously with the first bristle tufts engaging the biting surface of the tooth, the free ends of said first array of second bristle tufts contact the inner side of the tooth and adjacent gums and the free ends of said second array of second bristle tufts contact the outer side of the tooth and adjacent gums.

2. A toothbrush as recited in claim 1 wherein the first shape of said resilient member is essentially planar when said member is in an unflexed position.

3. A toothbrush as recited in claim 1 wherein the first shape of said resilient member is arcuate in transverse cross-section when said member is in an unflexed position.

4. A toothbrush as recited in claim 7 wherein said resilient member has a convex face and a concave face in the unflexed position, said first and second bristle tufts being affixed to said convex face of the resilient member.

5. A toothbrush as recited in claim 3 comprising:

a second resilient member formed for resilient flexure between an arcuate shape in the unflexed position and a second shape, said second resilient member having a convex face and a concave face, said second resilient member having first and second sides which are attached to said supporting means such that the concave faces of said first and second resilient members face one another when in the unflexed position;

a second array of first bristle tufts centrally positioned relative to the first and second sides of said second resilient member, each of said first bristle tufts in said second array having a free end and a fixed end that is affixed to the convex face of said second resilient member;

a third array of second bristle tufts aligned in parallel relation to said second array of first bristle tufts and positioned between said second array of first bristle tufts and the first side of said second resilient member, each of said second bristle tufts in said third array having a free end and a fixed end that is affixed to the convex face of said second resilient member, said second bristle tufts in said third array being longer than said first bristle tufts in said second array and being unconstrained from inclining relative to said second array of first bristle tufts; and a fourth array of second bristle tufts, aligned in parallel relation to said second array of first bristle tufts and positioned between said second array of first bristle tufts and the second side of said second resilient member, each of said second bristle tufts in said fourth array having a free end and a fixed end that is affixed to the convex face of said second resilient member, said second bristle tufts in said fourth array being longer than said first bristle tufts in said second array and being unconstrained from inclining relative to said second array of first bristle tufts.

6. A toothbrush as recited in claim 5 wherein said first and second arrays of first bristle tufts each comprises at least two columns of first bristle tufts.

7. A toothbrush as recited in claim 6 wherein said first, second, third, and fourth arrays of second bristle tufts each comprises at least two columns of second bristle tufts wherein the second bristle tufts in the column closer to the first bristle tufts are shorter than the second bristle tufts in the column more distant from the first bristle tufts.

8. A toothbrush as recited in claim 1 comprising an elongated handle joined to said supporting means adjacent the back end of said resilient member.

9. A toothbrush as recited in claim 8 wherein said supporting means comprises two elongated members in parallel spaced relation to each other, each member including a portion that extends beyond the back end of said resilient member and joined to said handle such that an opening is defined between said back end of said resilient member, the extended portions of said elongated members, and said handle, whereby when the toothbrush is urged against a row of teeth, a tooth positioned immediately adjacent to the teeth engaged by the toothbrush can pass through said opening and not block the flexure of said resilient member.

10. A toothbrush as recited in claim 1 wherein said array of first bristle tufts comprises at least two columns of first bristle tufts.

11. A toothbrush as recited in claim 10 wherein said first and second arrays of second bristle tufts each comprise at least two columns of second bristle tufts wherein the second bristle tufts in the column closer to the first bristle tufts are shorter than the second bristle tufts in the column more distant from the first bristle tufts.

* * * * *

UNITED STATES PATENT AND TRADEMARK OFFICE

CERTIFICATE OF CORRECTION

PATENT NO. : 5,483,722 
DATED : January 16, 1996
INVENTOR(S) : Paul A. Scheier and Louise E. Scheier It is certified that error appears in the above-identified patent and that said Letters Patent is hereby corrected as shown below:

Title page,
Item [*] Notice, should read
-- The portion of the term of this patent subsequent to Dec. 11, 2012, has been disclaimed. --.

Signed and Sealed this

Twenty-fifth Day of April, 2006

JON W. DUDAS
*Director of the United States Patent and Trademark Office*